US009447625B1

(12) United States Patent
Seebaransingh et al.

(10) Patent No.: US 9,447,625 B1
(45) Date of Patent: Sep. 20, 2016

(54) DOOR LOCK SYSTEM

(71) Applicants: Ravi Seebaransingh, Markham (CA); Cyntra Seebaransingh, Markham (CA)

(72) Inventors: Ravi Seebaransingh, Markham (CA); Cyntra Seebaransingh, Markham (CA)

( * ) Notice: Subject to any disclaimer, the term of this patent is extended or adjusted under 35 U.S.C. 154(b) by 0 days.

(21) Appl. No.: 14/802,393

(22) Filed: Jul. 17, 2015

(51) Int. Cl.

| | |
|---|---|
| ***E05F 15/73*** | (2015.01) |
| ***E05F 1/00*** | (2006.01) |
| ***E05F 15/616*** | (2015.01) |
| ***E05F 15/63*** | (2015.01) |
| ***E05C 19/02*** | (2006.01) |
| ***E06B 3/36*** | (2006.01) |

(52) U.S. Cl.
CPC ..... *E05F 15/73* (2015.01); *E05C 19/02* (2013.01); *E05F 1/002* (2013.01); *E05F 15/616* (2015.01); *E05F 15/63* (2015.01); *E06B 3/36* (2013.01); *E05Y 2400/40* (2013.01); *E05Y 2400/44* (2013.01); *E05Y 2900/112* (2013.01)

(58) Field of Classification Search
CPC ..... E05F 15/73; E05F 15/63; E05F 15/616; E05F 1/002; E05C 19/02; E06B 3/36
See application file for complete search history.

(56) References Cited

U.S. PATENT DOCUMENTS

| | | | | |
|---|---|---|---|---|
| 4,741,275 | A * | 5/1988 | Lewiner et al. | 109/7 |
| 5,515,649 | A | 5/1996 | Strab | |
| 5,583,405 | A | 12/1996 | Sai et al. | |
| 5,855,027 | A | 1/1999 | Macedo | |
| 6,967,587 | B2 * | 11/2005 | Snell et al. | 340/686.6 |
| 8,169,317 | B2 | 5/2012 | Lemerand et al. | |
| 8,284,018 | B2 | 10/2012 | Ibsies | |
| D689,385 | S | 9/2013 | Haws | |
| 8,888,045 | B2 * | 11/2014 | Boren et al. | 244/129.5 |
| 8,890,846 | B2 * | 11/2014 | Rostamianfar et al. | 345/175 |
| 2002/0092237 | A1 * | 7/2002 | Hebda | 49/339 |
| 2003/0066931 | A1 * | 4/2003 | Ward | 244/118.5 |
| 2009/0300988 | A1 * | 12/2009 | Bem | 49/340 |
| 2010/0253516 | A1 * | 10/2010 | Lemerand et al. | 340/545.1 |
| 2011/0080252 | A1 * | 4/2011 | Ibsies | 340/3.1 |
| 2012/0017367 | A1 * | 1/2012 | Reeder et al. | 4/597 |
| 2014/0267739 | A1 * | 9/2014 | Ibsies | 348/156 |
| 2014/0327545 | A1 * | 11/2014 | Bolling et al. | 340/573.1 |
| 2014/0340227 | A1 * | 11/2014 | Reed, Jr. | 340/573.1 |
| 2014/0375457 | A1 * | 12/2014 | Diaz | 340/573.1 |
| 2015/0128496 | A1 * | 5/2015 | Phillips | 49/13 |
| 2015/0233146 | A1 * | 8/2015 | Klevens et al. | |
| 2015/0320209 | A1 * | 11/2015 | Hasselback et al. | |

* cited by examiner

*Primary Examiner* — Jerry Redman

(57) ABSTRACT

A door lock system includes a door having an inner edge, an outer edge, an inner surface and an outer surface. A frame includes a first vertical section and a second vertical section. The inner edge is hingedly coupled to the first vertical section. The door extends between the first and second vertical sections to define a closed position. A drive assembly is attached to the door and to the frame. The drive assembly is actuated in a first direction to move the door to the closed position and in a second direction to move the door to an open position. An outer switch mounted on an outside surface of the frame is engaged to actuate the drive assembly in the second direction. An inner switch mounted on an inside surface of the frame is engaged to actuate the drive assembly in the first direction.

4 Claims, 5 Drawing Sheets

DOOR LOCK SYSTEM

BACKGROUND OF THE DISCLOSURE

Field of the Disclosure

The disclosure relates to door lock devices and more particularly pertains to a new door lock device for automatically opening or closing a door for a bathroom stall.

SUMMARY OF THE DISCLOSURE

An embodiment of the disclosure meets the needs presented above by generally comprising a door having an inner edge, an outer edge, an inner surface and an outer surface. A frame includes a first vertical section and a second vertical section which are spaced from each other. The inner edge is hingedly coupled to the first vertical section. The door extends between the first and second vertical sections to define a closed position. A drive assembly is attached to the door and to the frame. The drive assembly is actuated in a first direction to move the door to the closed position and in a second direction to move the door to an open position. An outer switch is mounted on an outside surface of the frame. The outer switch is positioned on the first vertical section and is electrically coupled to a control circuit. The control circuit is electrically coupled to the drive assembly. The control circuit sends an open signal to the drive assembly to actuate the drive assembly in the second direction. An inner switch is mounted on an inside surface of the frame and positioned on the vertical section. The inner switch is electrically coupled to the control circuit. The control circuit sends a close signal to the drive assembly to actuate the drive assembly in the first direction when the door is in the open position and the inner switch is actuated. The control circuit sends the open signal to the drive assembly when the door is in the closed position and the inner switch is actuated.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
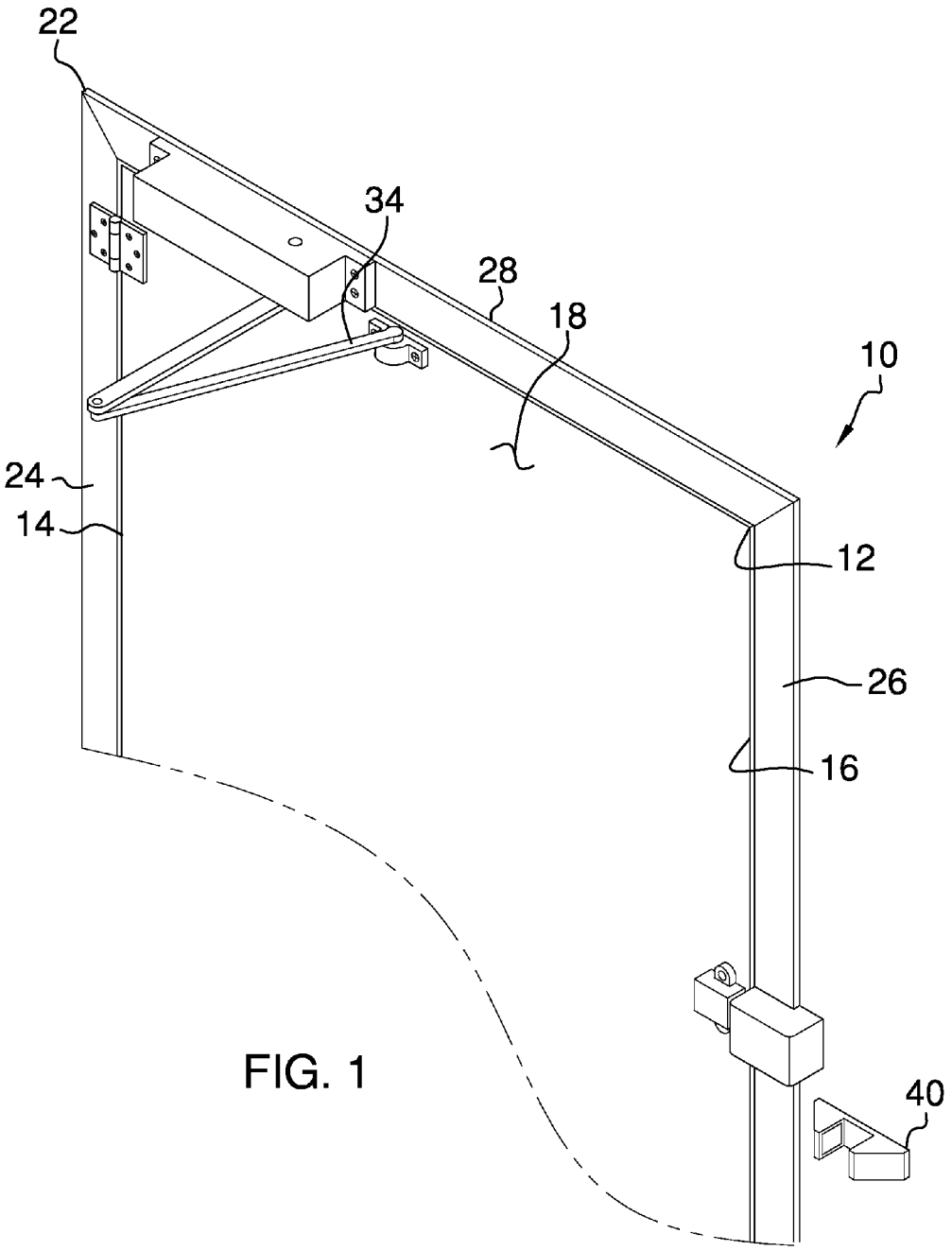
FIG. 1 is a perspective rear view of a door lock system according to an embodiment of the disclosure.
Figure 2:
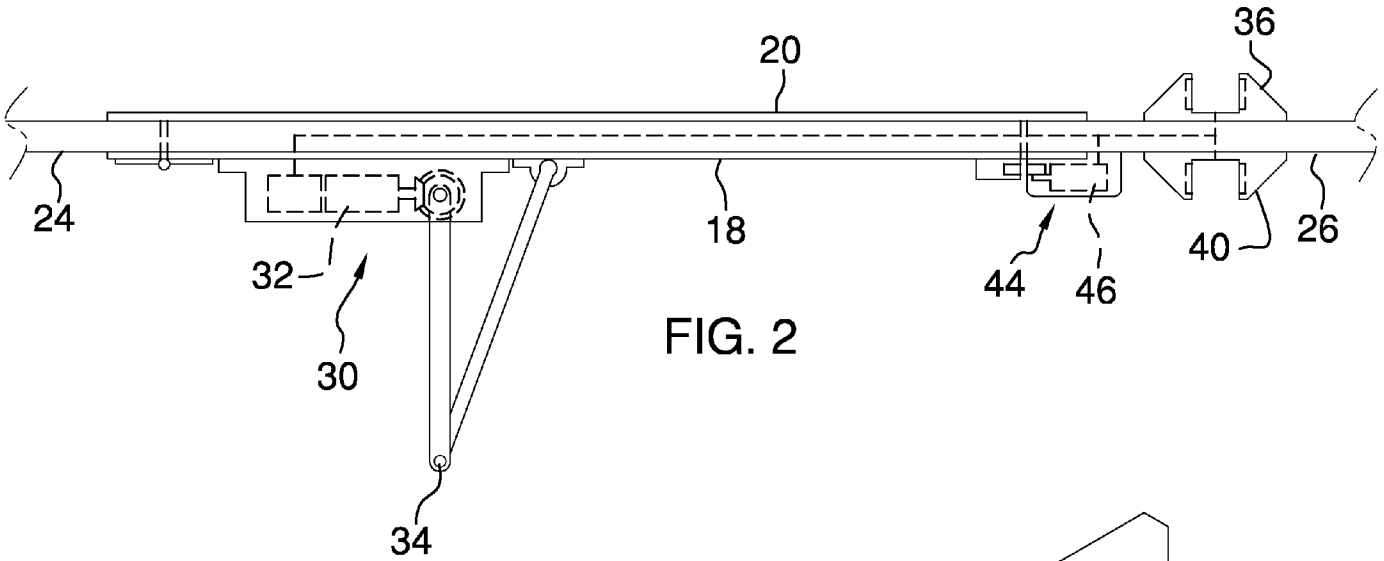
FIG. 2 is a top view of an embodiment of the disclosure.
Figure 3:
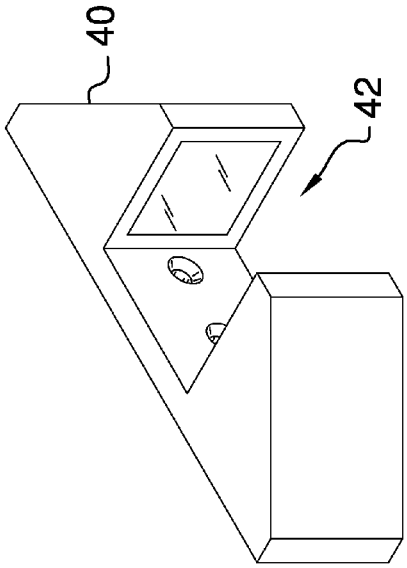
FIG. 3 is a perspective view of a sensor of an embodiment of the disclosure.
Figure 4:
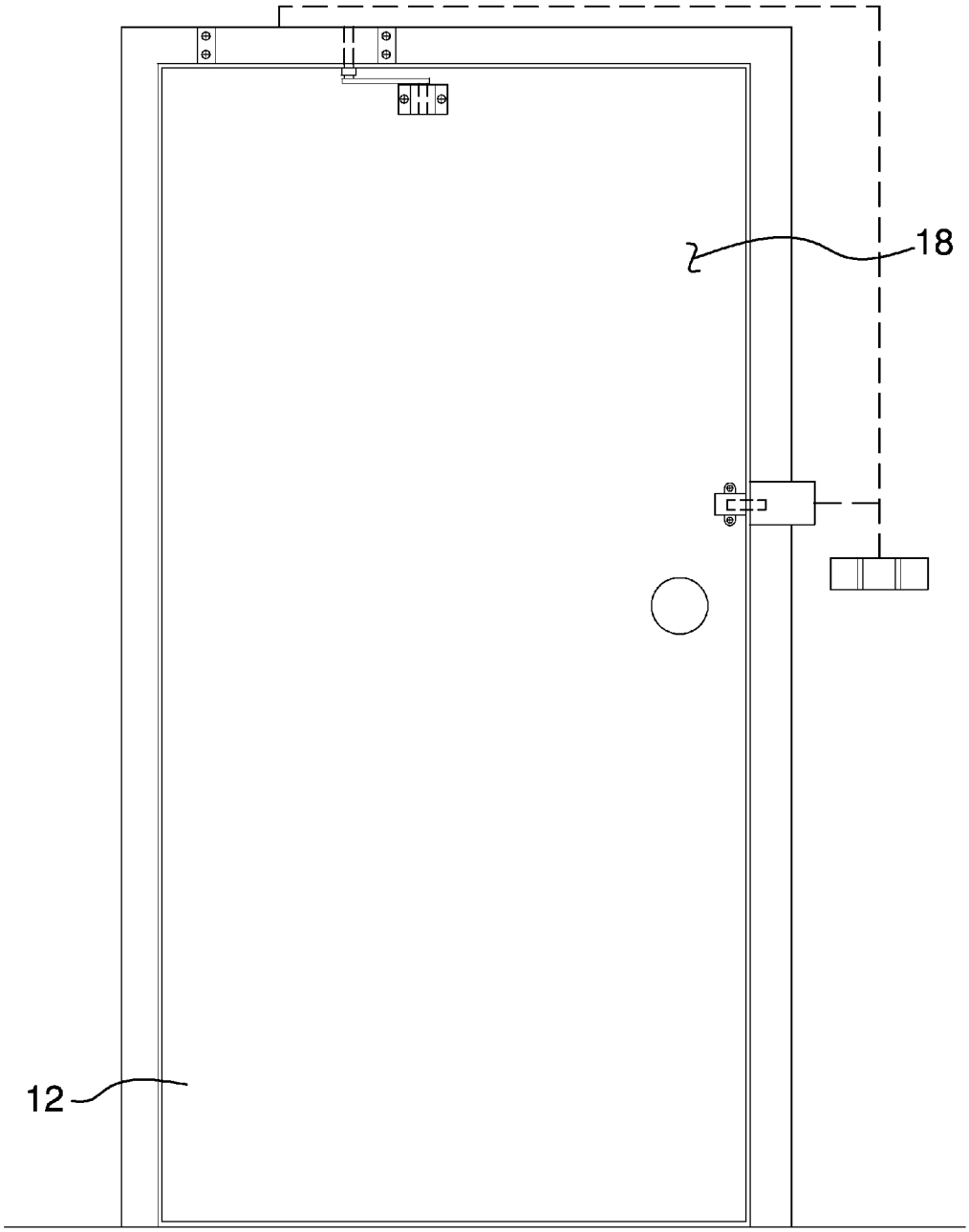
FIG. 4 is a rear view of an embodiment of the disclosure.
Figure 5:
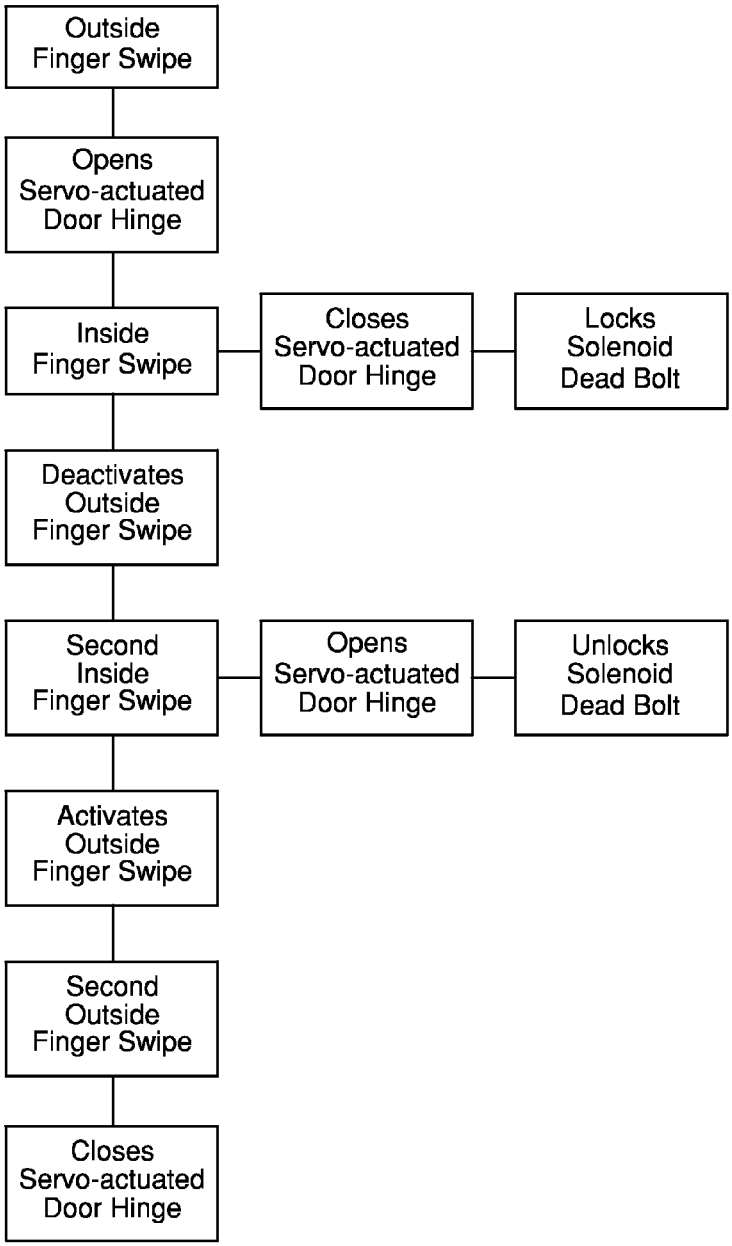
FIG. 5 is a schematic view of an embodiment of the disclosure.
Figure 6:
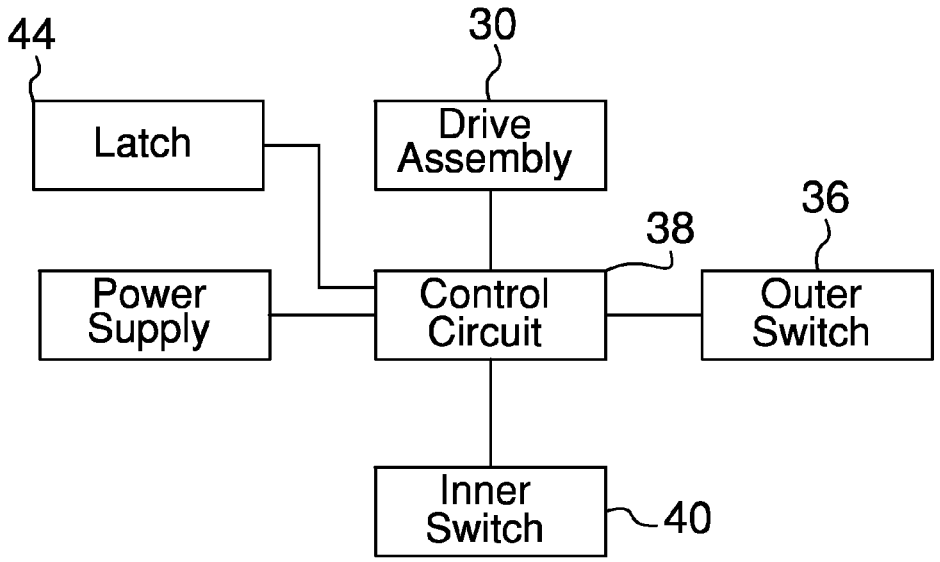
FIG. 6 is a schematic view of an embodiment of the disclosure.

With reference now to the drawings, and in particular to FIGS. 1 through 6 thereof, a new door lock device embodying the principles and concepts of an embodiment of the disclosure and generally designated by the reference numeral 10 will be described.

As best illustrated in FIGS. 1 through 6, the door lock system 10 generally comprises a door 12 having an inner edge 14, an outer edge 16, an inner surface 18 and an outer surface 20. A frame 22 includes a first vertical section 24 and a second vertical section 26 spaced from each other and the inner edge 14 is hingedly coupled to the first vertical section 24. The door 12 extends between the first 24 and second 26 vertical sections to define a closed position. More particularly, the door 12 may comprise a door 12 for a toilet stall wherein the frame 22 may only include the first 24 and second 26 vertical sections, though an upper section 28 may also be provided extending between the first 24 and second 26 vertical sections and which is positioned above the door 12.

A drive assembly 30 is attached to the door 12 and to the frame 22. The drive assembly 30 is actuated in a first direction to move the door 12 to the closed position and in a second direction to move the door 12 to an open position. The drive assembly 30 may be conventional to automatic door opening and closing assemblies. The drive assembly 30 may include a motor 32 which is engaged to an arm assembly 34 such that the arm assembly 34 is moved between a first position and a second position when the motor 32 is activated in a first direction or a second direction.

An outer switch 36 is mounted on an outside surface of the frame 22. The outer switch 36 is positioned on the second vertical section 26. The outer switch 36 is electrically coupled to a control circuit 38 and the control circuit 38 is electrically coupled to the drive assembly 30. The control circuit 38 sends an open signal to the drive assembly 30 to actuate the drive assembly 30 in the second direction when the outer switch 36 is actuated. An inner switch 40 is mounted on an inside surface of the frame 22 and positioned on the second vertical section 26. The inner switch 40 is electrically coupled to the control circuit 38. The control circuit 38 sends a close signal to the drive assembly 30 to actuate the drive assembly 30 in the first direction when the door is in the open position and the inner switch 40 is actuated. The control circuit 38 sends the open signal to the drive assembly 30 when the door 12 is in the closed position and the inner switch 40 is actuated. Each of the inner 40 and outer 36 switches may each comprise a sensor such as a motion sensor which detects motion within about 6.0 inches of the sensor. As can been seen in FIG. 3, the motion sensors may include a finger space 42 through which a user's finger may be moved to be detected by the motion sensors.

A latch 44 is mounted on the inside surface of the frame 22. The latch 44 is electrically driven, such as with a solenoid 46, and is electrically coupled to the control circuit 38. The latch 44 engages the door 12 when the inner switch 40 is actuated to move the door 12 to the closed position and the door 12 obtains the closed position. The latch 44 disengages the door 12 when the inner switch 40 is actuated when the door 12 is already in the closed position at the time of inner switch 40 actuation. The control circuit 38 may be programmed such that the outer switch 36 is deactivated when the latch 44 engages the door 12. Thus, when a person is within the bathroom stall, another person cannot use the outer switch 36 to open the door. Also, as can be seen from the step diagram of FIG. 5, after the door 12 has been opened, the system may cause the door 12 to again be moved to a closed, unlocked position, such that the door 12 may be opened by actuating the outer switch 36.

In use, the system 10 allows a person to open or close a close a door 12 to a bathroom stall without gripping a handle and thus more sanitarily use a toilet. The system 10 further locks the door 12 automatically when it is closed to prevent entry by another person.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An automatic door opening and locking system comprising:

a door having an inner edge, an outer edge, an inner surface and an outer surface;

a frame including a first vertical section and a second vertical section being spaced from each other, said inner edge being hingedly coupled to said first vertical section, said door extending between said first and second vertical sections to define a closed position;

a drive assembly being attached to said door and to said frame, said drive assembly being actuated in a first direction to move said door to said closed position and in a second direction to move said door to an open position;

an outer switch being mounted on an outside surface of said frame, said outer switch being electrically coupled to a control circuit, said control circuit being electrically coupled to said drive assembly, said control circuit sending an open signal to said drive assembly to actuate said drive assembly in said second direction when said outer switch is actuated; and an inner switch being mounted on an inside surface of said frame, said inner switch being electrically coupled to said control circuit, said control circuit sending a close signal to said drive assembly to actuate said drive assembly in said first direction when said door is in said open position and said inner switch is actuated, said control circuit sending said open signal to said drive assembly when said door is in said closed position and said inner switch is actuated;

each of said inner and outer switches comprises a motion sensor, each of said inner switch and said outer switch including a respective finger space positioned between two respective opposed surfaces such that said motion sensor is configured to be triggered by passing a finger through one of said finger spaces.

2. The automatic door opening and locking system according to claim 1, further including a latch being mounted on said inside surface of said frame, said latch being electrically coupled to said control circuit, said latch engaging said door when said inner switch is actuated to move said door to said closed position and said door is in said closed position, said latch disengaging said door when said inner switch is actuated to when said door is in said closed position.

3. The automatic door opening and locking system according to claim 2, wherein said outer switch is deactivated when said latch engages said door.

4. An automatic door opening and locking system comprising:

a door having an inner edge, an outer edge, an inner surface and an outer surface;

a frame including a first vertical section and a second vertical section being spaced from each other, said inner edge being hingedly coupled to said first vertical section, said door extending between said first and second vertical sections to define a closed position;

a drive assembly being attached to said door and to said frame, said drive assembly being actuated in a first direction to move said door to said closed position and in a second direction to move said door to an open position;

an outer switch being mounted on an outside surface of said frame, said outer switch being positioned on said second vertical section, said outer switch being electrically coupled to a control circuit, said control circuit being electrically coupled to said drive assembly, said control circuit sending an open signal to said drive assembly to actuate said drive assembly in said second direction when said outer switch is actuated;

an inner switch being mounted on an inside surface of said frame and positioned on said second vertical section, said inner switch being electrically coupled to said control circuit, said control circuit sending a close signal to said drive assembly to actuate said drive assembly in said first direction when said door is in said open position and said inner switch is actuated, said control circuit sending said open signal to said drive assembly when said door is in said closed position and said inner switch is actuated;

each of said inner and outer switches comprising a sensor, said sensor being a motion sensor, each of said inner switch and said outer switch including a respective finger space positioned between two respective opposed surfaces such that said motion sensor is configured to be triggered by passing a finger through one of said finger spaces;

a latch being mounted on said inside surface of said frame, said latch being electrically coupled to said control circuit, said latch engaging said door when said inner switch is actuated to move said door to said closed position and said door is in said closed position, said latch disengaging said door when said inner switch is actuated to when said door is in said closed position; and said outer switch being deactivated when said latch engages said door.

* * * * *